US009028745B2

(12) United States Patent
Zhu et al.

(10) Patent No.: US 9,028,745 B2
(45) Date of Patent: May 12, 2015

(54) LOW NICKEL AUSTENITIC STAINLESS STEEL

(75) Inventors: Shouxing Zhu, Shanghai (CN); Li Xu, Shanghai (CN); Balasubramani Nandagopal, Bangalore (IN)

(73) Assignee: Honeywell International Inc., Morristown, NJ (US)

( * ) Notice: Subject to any disclaimer, the term of this patent is extended or adjusted under 35 U.S.C. 154(b) by 815 days.

(21) Appl. No.: 13/286,373

(22) Filed: Nov. 1, 2011

(65) Prior Publication Data

US 2013/0108426 A1 May 2, 2013

(51) Int. Cl.

| | |
|---|---|
| ***C22C 38/58*** | (2006.01) |
| ***C22C 38/38*** | (2006.01) |
| ***C22C 38/48*** | (2006.01) |
| ***C22C 38/44*** | (2006.01) |

(52) U.S. Cl.
CPC ..... *C22C 38/58* (2013.01)

(58) Field of Classification Search
CPC ..... C22C 38/48; C22C 38/54; C22C 38/58; C22C 38/44
USPC ..... 420/64, 57, 69; 148/326
See application file for complete search history.

(56) References Cited

U.S. PATENT DOCUMENTS

| | | | | |
|---|---|---|---|---|
| 3,250,612 | A | 5/1966 | Roy et al. | |
| 3,940,266 | A | 2/1976 | Goller et al. | |
| 3,989,474 | A | 11/1976 | Goller et al. | |
| 5,231,833 | A * | 8/1993 | MacLean et al. | 60/734 |
| 6,056,917 | A | 5/2000 | Chesseret et al. | |
| 6,274,084 | B1 | 8/2001 | Haudrechy | |
| 6,770,243 | B2 | 8/2004 | Kloss-Ulitzka et al. | |
| 6,824,672 | B2 | 11/2004 | Lecour et al. | |
| 7,767,038 | B2 | 8/2010 | Kim | |
| 7,780,908 | B2 | 8/2010 | Meng-Hsin et al. | |
| 2006/0266439 | A1 | 11/2006 | Maziasz et al. | |

FOREIGN PATENT DOCUMENTS

| | | |
|---|---|---|
| CN | 1500894 | 6/2004 |
| CN | 101509104 | 8/2009 |

(Continued)

OTHER PUBLICATIONS

Dafang, et al., "Study of the Structure and Performance of K273 Cast High-Temperature Alloy,"*Shanghai Metals*, Jan. 1988, pp. 42-49, vol. 10, No. 1, China Academic Journal Electronic Publishing House.

(Continued)

*Primary Examiner* — Jessee Roe
(74) *Attorney, Agent, or Firm* — Ingrassia Fisher & Lorenz, P.C.

(57) ABSTRACT

Various embodiments of the invention provide a low nickel austenitic stainless steel alloy composition including about 0.6% to about 0.8% by weight carbon; about 16% to about 18% by weight chromium; about 4.5% to about 5.5% by weight nickel; about 2.0% to about 5.0% by weight manganese; about 0.8% to about 1.2% by weight tungsten; about 0.8% to about 1.2% by weight molybdenum; about 0.65% to about 0.85% by weight niobium; about 0.3% to about 1.0% by weight silicon; balance iron and unavoidable impurities, wherein percentages are based on the overall weight of the composition. The invention further provides articles, such as turbine housings, prepared using the inventive alloys.

18 Claims, 5 Drawing Sheets

(56) References Cited

FOREIGN PATENT DOCUMENTS

Figure 1:
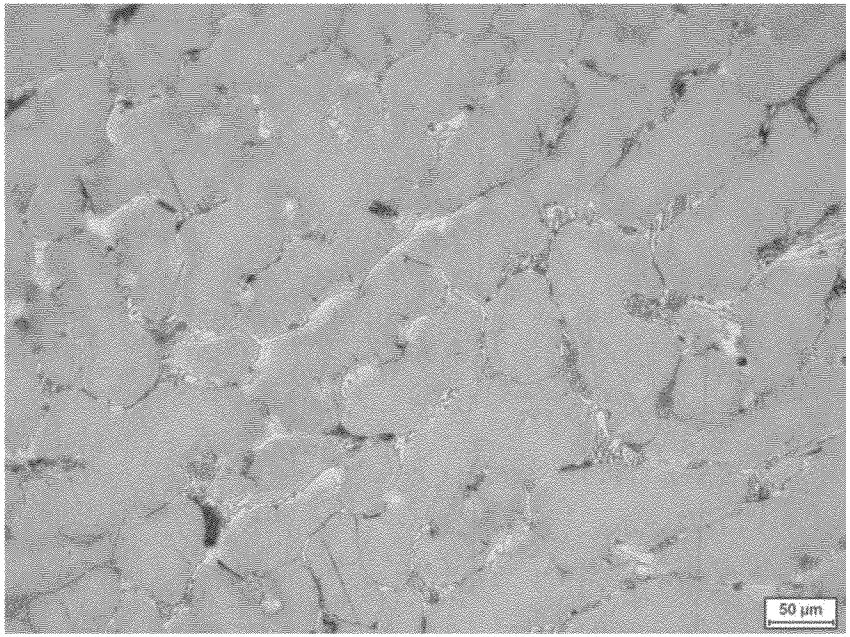

| | | | |
|---|---|---|---|
| CN | 101845605 | | 9/2010 |
| GB | 803816 | A | 11/1958 |
| GB | 1073971 | A | 6/1967 |
| WO | 2010036533 | A1 | 4/2010 |
| WO | WO-2010/036533 | A2 | 4/2010 |

OTHER PUBLICATIONS

Maziasz, et al. "High-Temperature Cast Stainless Steel," *Advanced Materials and Processes*, Oct. 2003, pp. 57-59.

USPTO International Preliminary Report on Patentability, Notification Date May 6, 2014; Application No. PCT/US/2012/062683.

International Search Report for Application No. PCT/US2012/062683; dated Mar. 18, 2013.

* cited by examiner

LOW NICKEL AUSTENITIC STAINLESS STEEL

FIELD OF THE INVENTION

The invention relates to alloy compositions useful in the preparation of articles for use in applications where high heat resistance is desired. The alloy compositions are particularly stainless steel alloys.

BACKGROUND OF THE INVENTION

Stainless steels are most commonly used for their corrosion resistance. However, another common reason for their use is for high temperature applications in which high temperature oxidation resistance may be necessary and/or high temperature strength may be required. The high chromium content of stainless steels not only provides the benefit with respect to wet corrosion resistance but also provides the benefit of high temperature strength and resistance to scaling at elevated temperatures.

A stainless steel contains a minimum of 10.5% chromium to provide the formation of a stable, transparent, passive, protective film that enhances corrosion resistance. In addition, such a chromium level provides resistance to oxidation at elevated temperatures. In many instances, nickel is also added to the composition for a stainless steel to promote a stable austenite microstructure. Austenite is stronger and more stable at higher temperatures than ferrite. A common problem that may be experienced in stainless steels is the formation of sigma phase in high temperature applications. The effect of the formation of this phase is the phase may cause the steel to be extremely brittle and failure can occur because of brittle fracture. When nickel is added to a chromium stainless steel, the microstructure of the steel changes from ferritic to austenitic. Thus, the addition of nickel suppresses the formation of sigma phase and promotes the formation of austenite. In addition, nickel also increases resistance to oxidation, carburization, nitriding, thermal fatigue, and strong acids.

Nickel is an expensive raw material and suffers from a large fluctuation in price, which has become increasingly volatile. The high cost of nickel directly impacts the cost of producing the grade of stainless steel. Therefore, efforts have been made to replace the nickel with other alloying elements such as carbon, manganese, nitrogen, and copper. Such elements are lower in cost than nickel and may still promote the formation of austenite.

Accordingly, it would be beneficial to produce an alternative alloy for use in applications requiring the use of stainless steel that is capable of withstanding high temperatures and promoting the required microstructure, while minimizing the amount of nickel to keep costs low and more predictable.

BRIEF SUMMARY OF THE INVENTION

Various embodiments of the present invention provide alloy compositions useful for preparing articles having high performance properties, particularly high strength and heat resistance. The alloys of various embodiments are particularly useful in that they can be prepared using lower cost materials than presently known heat-resistant stainless steels. For instance, various inventive alloys disclosed herein are heat-resistant stainless steel alloys that comprise a specific elemental make-up designed to retain preferred properties for a heat-resistant material but with a lowered preparation cost.

Various embodiments of the alloy according to the present invention can be used in the preparation of any metallic article, but they are particularly useful in the preparation of material having high performance specifications, especially with respect to strength and heat resistance. One field where the alloys of the invention are especially beneficial is in the preparation of engine parts, such as turbine housings and exhaust manifolds.

In particular embodiments, the invention is directed to a stainless steel alloy composition. In particular embodiments of the invention, only a few specific elements of the alloy composition need be present in specific amounts in order for the alloy composition to be useful in preparing articles having desired physical properties as described herein. For example, in one embodiment, an alloy composition according to the invention comprises: about 0.6% to about 0.8% by weight carbon; about 16% to about 18% by weight chromium; about 4.5% to about 5.5% by weight nickel; about 2.0% to about 5.0% by weight manganese; about 0.8% to about 1.2% by weight tungsten; about 0.8% to about 1.2% by weight molybdenum; about 0.65% to about 0.85% by weight niobium; about 0.3% to about 1.0% by weight silicon; and balance iron and unavoidable impurities, wherein percentages being based on the overall weight of the alloy composition.

In other embodiments, an alloy composition according to the invention comprises: about 0.6% to about 0.75% by weight carbon; about 16% to about 18% by weight chromium; about 4.5% to about 5.5% by weight nickel; about 2.0% to about 4.5% by weight manganese; about 0.8% to about 1.2% by weight tungsten; about 0.8% to about 1.2% by weight molybdenum; about 0.65% to about 0.85% by weight niobium; about 0.3% to about 1.0% by weight silicon; and balance iron and unavoidable impurities, wherein percentages being based on the overall weight of the alloy composition.

According to further embodiments, the inventive alloy may comprise one or more optional trace elements. For instance, in one embodiment, the alloy may comprise, in addition to the above elements, one or more of: up to about 0.15% by weight nitrogen; up to about 0.005% by weight boron; up to about 0.03% by weight phosphorus; and up to about 0.03% by weight sulfur, based on the overall weight of the composition.

In various embodiments, the alloy formed from the alloy composition has an austenitic structure having chromium carbides. Further, in various embodiments, the alloy has an austenitic structure having MC and/or M7C3 carbides. Yet further, in particular embodiments, the alloy has an austenitic structure having M23C6 carbides form during long-term thermal soaking According to various embodiments, the alloy composition described herein may be used in the preparation of a variety of articles. For instance, the alloy composition may be used in the preparation of any article commonly prepared from austenitic stainless steels. Various embodiments of the alloys of the invention are particularly useful for preparing articles for use in applications where the ability to support a high thermo-mechanical load is desired. For example, in one embodiment, various embodiments of the alloy are used to form a turbine housing or turbine manifold.

As previously noted, articles that must support high thermo-mechanical loads, such as turbine housings, must be capable of meeting certain specific physical and mechanical requirements. Articles according to various embodiments of the present invention are particularly beneficial in that the articles are capable of meeting strict physical and mechanical requirements. For instance, in one embodiment, the invention provides an article having at least one of an ultimate tensile strength of at least 465 MPa, a yield strength (proof stress) of at least 370 MPa, and a percent elongation of at least 2% at room temperature when measured according to ASTM E8. In addition, in one embodiment, the invention provides an article having a hardness between 170 and 260 BHM at room temperature when measured according to EN ISO 6506-1: 2005.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 1 provides the microstructure of material conforming to an alloy composition according to an embodiment of the invention.

Figure 2:
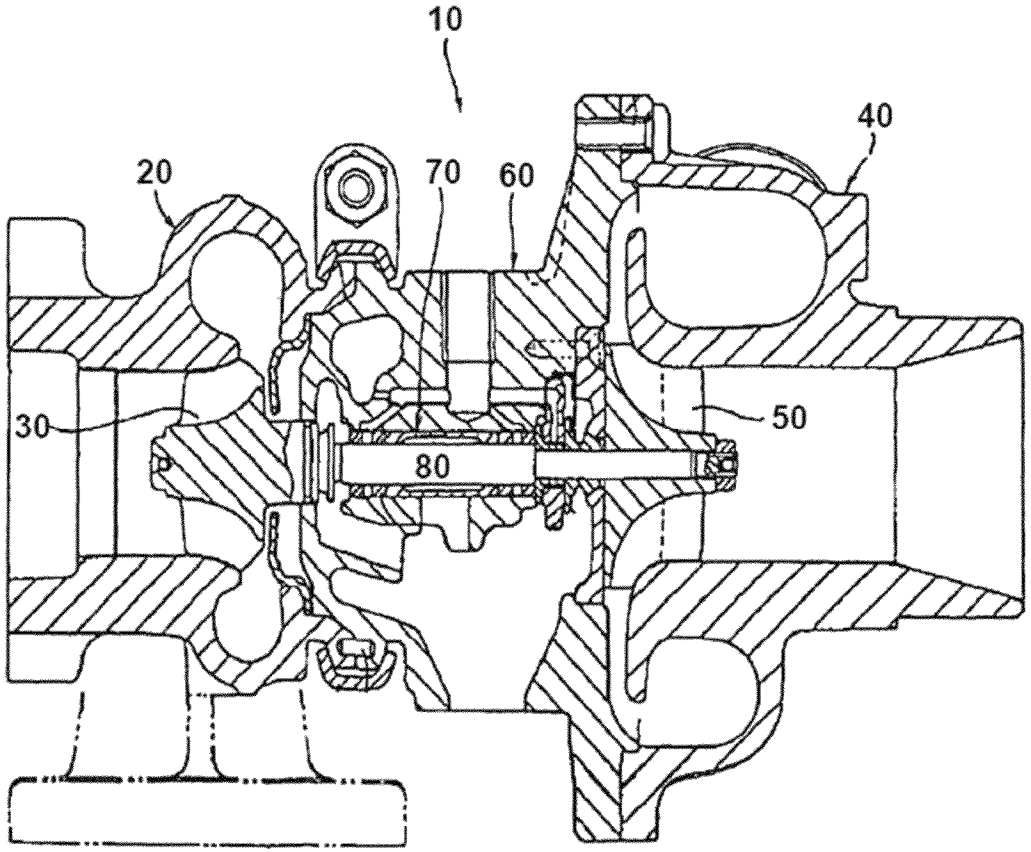

FIG. 2 is a view of a turbocharger, item 20 being a turbine housing according to an embodiment of the invention.

Figure 3:
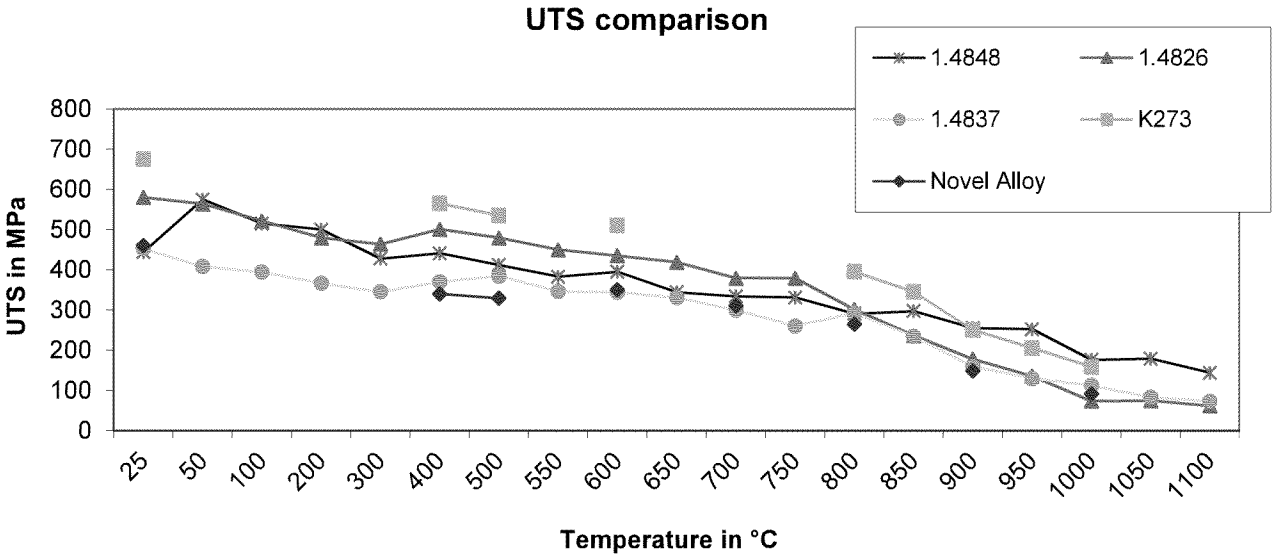

FIG. 3 provides a chart showing the ultimate tensile strength of a novel alloy according to various embodiments of the invention in comparison to commercially-known heat-resistant steels.

Figure 4:
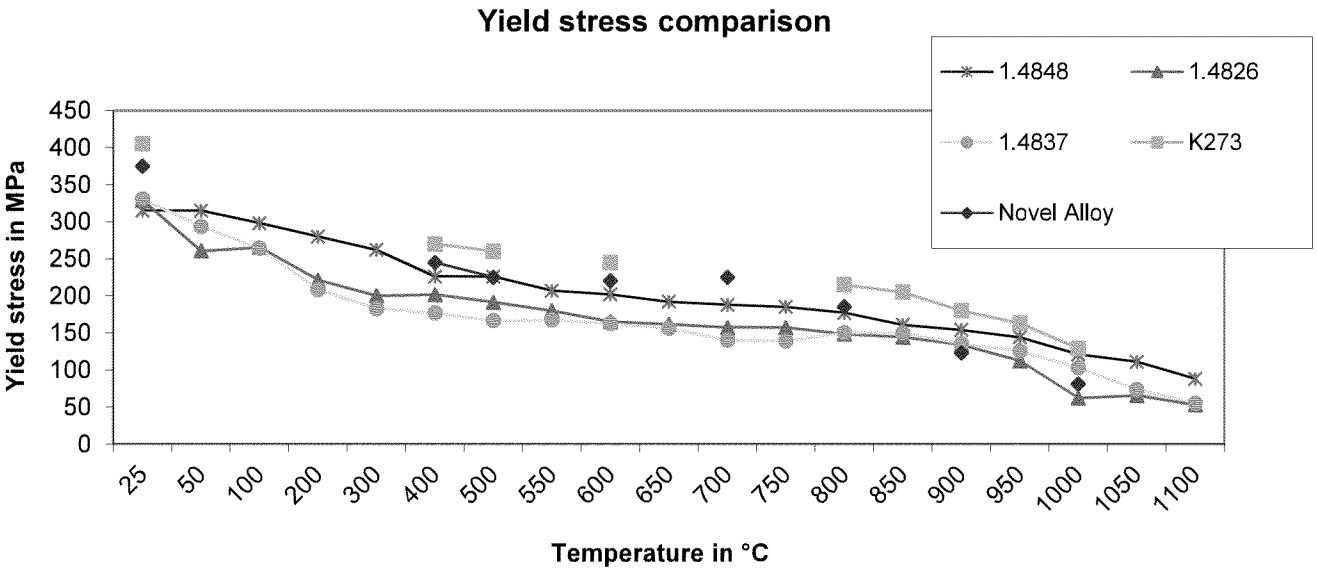

FIG. 4 provides a chart showing the yield strength (proof stress) of a novel alloy according to various embodiments of the invention in comparison to commercially-known heat-resistant steels.

Figure 5:
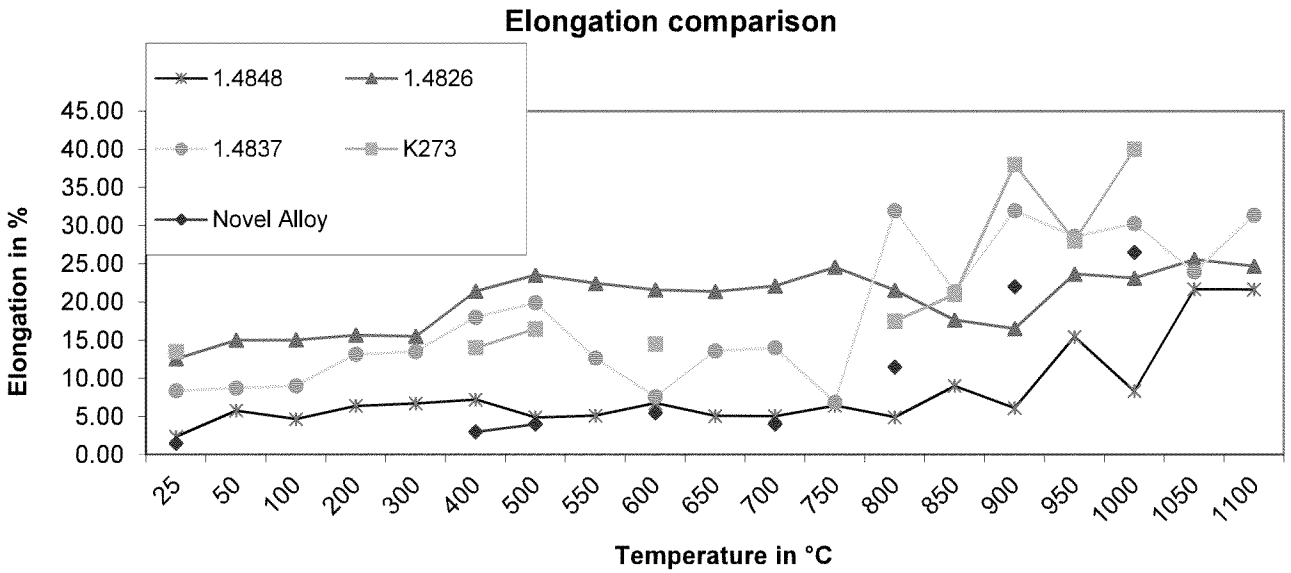

FIG. 5 provides a chart showing the elongation of a novel alloy according to various embodiments of the invention in comparison to commercially-known heat-resistant steels.

DETAILED DESCRIPTION OF THE INVENTION

The present invention will now be described more fully hereinafter with reference to specific embodiments of the invention and particularly to the various drawings provided herewith. Indeed, the invention may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The present invention is directed to heat resistant stainless steel alloys. As such, the alloy compositions comprise iron as the major alloying element (or alloy component). Generally, as the major alloying element, iron is present in an amount greater than any other single element present in the alloy. In a preferred embodiment, iron is present in an amount greater than the sum of the remaining alloying elements. That is, iron comprises greater than 50% by weight of the alloy composition, based on the overall total weight of the composition.

According to further embodiments of the invention, the alloy composition may be described in terms of including a group of specific alloying elements in specific amounts. In such embodiments, the amount of iron present in the alloy can be referred to in terms of iron and unavoidable impurities forming the balance of the alloy. When described in such terms, it is understood that the balance being iron indicates that the actual concentration (in weight percent, based on the overall weight of the alloy) of iron present can be determined by obtaining the sum of the concentration of the other elements present and subtracting that sum from 100, the remainder representing the concentration of iron present in the alloy (i.e., the balance).

The alloy compositions of various embodiments of the invention are particularly characterized in that the alloy compositions provided herein may be used in the preparation of articles that meet or exceed mechanical and physical requirements necessary for high stress, high heat applications, yet the elemental makeup of the alloy compositions is such that the alloys may be prepared at a reduced cost in comparison to commercially-known heat-resistant stainless steel alloys. For instance, in certain embodiments, the alloy compositions of the invention achieve similar mechanical and physical requirements as 1.4848 heat resistant steel commonly used for high stress, high-heat applications, but comprises decreased amount of nickel relative to 1.4848, which typically has nickel ranging from 19.0 to 21.0 weight percent. The decreased amount of nickel in the alloy of various embodiments of the present invention reduces the cost of producing the alloy relative to the 1.4848 steel grade. Further, in preferred embodiments, this decreased nickel content can be achieved without adversely affecting the physical properties of the alloy as compared to the 1.4848 steel grade.

In particular embodiments, the alloy composition comprises carbon in an amount of about 0.6% to about 0.8% by weight, based on the overall weight of the alloy composition. In preferred embodiments, carbon is present in an amount of about 0.6% to about 0.75% by weight. In addition, in particular embodiments, the alloy composition comprises manganese in an amount of about 2.0% to about 5.0% by weight, based on the overall weight of the alloy composition. In preferred embodiments, manganese is present in an amount of about 2.0% to about 4.5% by weight. Such levels of carbon and manganese are used in various embodiments of the alloy composition to replace nickel.

As previously discussed, nickel is typically added to help austenitize the matrix structure of the material. For instance, 300 series stainless steels typically have a nickel range of about 8.0% to 15.0% by weight. However, in various embodiments, less nickel is needed to retain the austenitic structure as the carbon and manganese levels are increased with respect to typical temperature resistant stainless steels. Thus, in particular embodiments, the alloy composition comprises nickel in an amount of about 4.5% to about 5.5% by weight, based on the overall weight of the alloy composition.

In various embodiments, the carbon and manganese content are added to promote the best phase composition of the material. For instance, in comparison with commercially-available materials used for gasoline turbine housings, various embodiments of the alloy composition have a superior phase composition. For example, in particular embodiments, the microstructure includes interdendritic eutectic chromium carbides in an austenitic matrix such as the microstructure shown in FIG. 1. Furthermore, in particular embodiments, the microstructure experiences no change in the primary phase after being exposed to high temperatures for an extended period. For example, a static thermal soaking test was conducted on a particular alloy composition and after 275 hours in a furnace at 950° C., the microstructure experienced no new phases and the oxidation measured at the equivalent level of mature high nickel materials such as D5S In addition to carbon, manganese, nickel, and iron, the alloy compositions of various embodiments of the invention may contain one or more further alloying elements that may be useful for imparting beneficial properties to the alloy composition. Elements useful in certain preferred embodiments are described herein. Nevertheless, the inclusion of certain further elements and/or the exclusion of certain further elements are not intended to limit the scope of the invention. Rather, the further elements described herein are only preferred, and further elements, as deemed beneficial, can be incorporated in the alloy without departing from the present invention. The amounts in which the further elements are included are based on the weight of the overall composition.

In particular embodiments, the alloy composition comprises chromium in an amount of about 16% to about 18% by weight, based on the overall weight of the alloy composition. The chromium may help to precipitate carbides in the austenitic matrix, thereby improving the high-temperature yield strength by precipitation strengthening of the matrix. In addition, as previously discussed, the chromium may facilitate the formation a dense, passive film of chromium oxide near the surface, thereby improving oxidation resistance.

In addition, in particular embodiments, the alloy composition comprises molybdenum in an amount of about 0.8% to about 1.2% by weight, based on the overall weight of the alloy composition. Further, in particular embodiments, the alloy composition comprises tungsten in an amount of about 0.8% to about 1.2% by weight, based on the overall weight of the alloy composition. Similar to chromium, these elements may help to precipitate carbides in the austenite matrix, and may thereby increase the high-temperature yield strength (proof stress) by precipitation strengthening throughout the entire range of temperatures at which the alloy may be used. Furthermore, molybdenum may improve resistance to pitting and crevice corrosion.

In particular embodiments, the alloy composition comprises niobium in an amount of about 0.65% to about 0.85% by weight, based on the overall weight of the alloy composition. Niobium additions may improve high temperature creep strength. In addition, in particular embodiments, the alloy composition comprises silicon in an amount of about 0.3% to about 1.0% by weight, based on the overall weight of the alloy composition. Silicon may be added to increase casting fluidity and to improve castability. In addition, silicon may also improve oxidation resistance, particularly in instances in which volatile oxides such as tungsten and/or niobium are added to improve high temperature strength.

In addition to the above elements, in some embodiments, the alloy composition of the invention may comprise one or more elements present in trace amounts, and such elements may be referred to as trace elements. The term "trace element" as used herein means any element present in the alloy composition of the invention for which no minimum content is required. Trace elements, therefore, can be completely absent from the alloy composition. Trace elements may be present in the alloy as a direct result of the process used in preparing the alloy, or other elements may be intentionally included in the alloy composition, albeit in small amounts. If one or more trace elements is included in the alloy composition, it is preferably present at less than or equal to a maximum amount.

For example, in particular embodiments, the alloy composition comprises nitrogen in an amount of up to about 0.15% by weight, based on the overall weight of the alloy composition. Nitrogen may improve pitting resistance and retard the kinetics of sigma phase formation. In particular instances, nitrogen may be added during the melting process through the addition of raw materials such as manganese iron with nitrogen. The addition of nitrogen may promote the forming of austenite as well as the forming of MC type carbides. Such carbides help to strengthen grain boundaries at elevated temperatures and improve high temperature dynamic properties such as creep, stress rupture, and fatigue.

In addition, in particular embodiments, the alloy composition may comprise boron in an amount of up to about 0.005% by weight, phosphorous in an amount of up to about 0.03% by weight, and sulfur in an amount of up to about 0.03% by weight, based on the overall weight of the alloy composition. These additions may provide other beneficial properties to the material, such as for example, sulfur may improve the machinability of the material.

Further, in certain embodiments, trace elements may be impurities. As common to alloying processes, particularly where lower cost materials are used in preparing the alloy, it is common for various impurities to be introduced into the alloy composition. Accordingly, any element present in the alloy composition that is not necessarily desired as an alloying element may be considered an impurity. For instance, elements that may be present in trace amounts in the alloy composition of the present invention include, but are not limited to, calcium and sodium. The amount of a single impurity is preferably no more than about 0.1%. In preferred embodiments, the combined amount of all impurities is below about 1%, preferably below about 0.5%, below about 0.4% or below about 0.3% by weight.

The advantages of the inventive alloy, particularly in relation to maintaining the overall strength associated with the alloy while reducing the overall cost of the alloy, can be achieved, in certain embodiments, by using specified amounts of these elements. In particular embodiments, the alloy composition comprises carbon in an amount ranging from about 0.6 to about 0.8%, manganese in an amount from about 2.0% to about 5.0%, nickel in an amount from about 4.5% to about 5.5%, and chromium in an amount from about 16% to about 18%, all percentages by weight and based on the total weight of the overall alloy composition. In other embodiments of the invention, it is beneficial for the alloy composition of the invention to have a specifically defined composition. For example, in specific embodiments, the invention is directed to alloy compositions as shown in Tables 2 and 3.

TABLE 2

| | Min | Max |
|---|---|---|
| C | about 0.6 | About 0.8 |
| Mn | about 2.0 | about 5.0 |
| Cr | about 16 | about 18 |
| Ni | about 4.5 | about 5.5 |
| W | about 0.8 | about 1.2 |
| Mo | about 0.8 | about 1.2 |
| Nb | about 0.65 | about 0.85 |
| Si | about 0.3 | about 1.0 |
| N | about <0.15 | |
| B | about <0.005 | |
| P | about <0.03 | |
| S | about <0.03 | |
| Fe + impurities | balance | |

TABLE 3

| | Min | Max |
|---|---|---|
| C | about 0.6 | About 0.75 |
| Mn | about 2.0 | about 4.5 |
| Cr | about 16 | about 18 |
| Ni | about 4.5 | about 5.5 |
| W | about 0.8 | about 1.2 |
| Mo | about 0.8 | about 1.2 |
| Nb | about 0.65 | about 0.85 |
| Si | about 0.3 | about 1.0 |
| N | about <0.15 | |
| B | about <0.005 | |
| P | about <0.03 | |
| S | about <0.03 | |
| Fe + impurities | balance | |

Various embodiments of the alloy compositions of the present invention are suitable for use in preparing a variety of articles by any methods generally known in the art. Specifically, various embodiments of the alloy compositions may be used in the preparation of any article commonly prepared from austenitic stainless steel alloys. For instance, various embodiments of the alloys may be particularly useful for preparing articles for use in applications where the ability to support a high thermo-mechanical load is desired. For example, in one specific embodiment, the invention is directed to a turbocharger housing formed from an embodiment of an alloy composition as described herein. One embodiment of a turbocharger housing of the present invention is shown in FIG. 2. In particular, FIG. 2 illustrates a turbocharger 10. The turbocharger 10 includes a turbine housing 20 that houses a turbine wheel 30 as well as a compressor housing 40. The compressor housing 40 houses a compressor impeller 50 and a bearing housing 60 for housing a set of bearings. The set of bearings 70 supports a rotating shaft 80 that connects the turbine wheel 30 to the compressor impeller 50. In particular embodiments, one or more of the turbocharger 10, the turbine housing 20, the bearing housing 60 and the compressor housing 40 may comprise an embodiment of an alloy as described herein.

Various embodiments of the alloy may be prepared using any of the various traditional methods of metal production and forming. Traditional casting is the most common process for forming slabs and/or ingots of these alloys, although other methods may be used. Thermal and thermo-mechanical processing techniques common in the art for the formation of other alloys are suitable for use in manufacturing and strengthening the alloys of the present invention.

For instance, in particular embodiments, one or more of the alloy compositions can be used in a conventional shell mold casting technique to prepare articles, such as turbocharger housings. Shell mold casting is a process similar to sand casting, in that molten metal is poured into an expendable mold. However, in shell mold casing, the mold is typically a thin-walled shell created from applying a sand-resin mixture around a pattern. The pattern being a metal piece in the shape of the desired part may be reused to form multiple shell molds. For example, a two-piece metal pattern is created in the shape of the desired part, typically from iron or steel. Each half of the pattern is then heated to temperature, such as 175-370° C., for example, and coated with a lubricant to facilitate removal. Next, the heated pattern is clamped to a dumb box that contains a mixture of sand and resin binder. The dump box is inverted to allow the sand-resin mixture to coat the pattern and the heated pattern partially cures the mixture to form a shell around the pattern. Each half of the pattern is then cured to completion in an oven and the shell is ejected from the pattern. The two halves of the pattern are joined together and securely clamped to form the complete shell mold. The shell is then placed into a flask and supported by a backing material. The molten metal is then poured from a ladle into a gating system and fills the mold cavity. After the mold has been filled, the molten metal is allowed to cool and solidify into the shape of the final casting. After the mold has cooled, the mold is broken and the casting is removed. The casting may require trimming and cleaning to remove any excess metal and sand.

As indicated above, in preferred embodiments, the stainless steel alloy has an austenitic structure. Specifically, in preferred embodiments, the stainless steel alloy of the invention has a microstructure comprising chromium carbides in a matrix of austenite. In particular embodiments, the primary carbides are in the formation of MC and M7C3. Further, in particular embodiments, under long-time thermal soaking, such as 275 hours, the primary carbides are in the formation of MC and stable M23C6. It is noted that for various embodiments, the formation of no other detrimental and/or non-stable phase such as eta and/or sigma phase takes place and the matrix maintains a good consistency of austenite with carbides at the grain boundary. In addition, it is further noted that in various embodiments, the microstructure is evaluated by preparing the samples by standard metallographic techniques and etched.

In some embodiments of the present invention, the extent and form of porosity may be specified. Porosity may be present in clustered form, uniformly dispersed, or exhibiting directionality in alignment with dendrite growth. Porosity may be detected by sectioning, grinding, and polishing. In preferred embodiments, the porosity is minimized.

In various instances, articles prepared using certain embodiments of the inventive alloy composition described herein are expected to meet or exceed increased performance requirement for use in high temperature applications. Certain embodiments of the alloy composition of the invention provide for the preparation of articles having mechanical properties (such as ultimate tensile strength, yield strength, and elongation), that exemplify excellent performance at increased temperatures.

In preferred embodiments, alloys of the present invention may display a tensile strength of at least about 465 MPa, a 0.2% yield strength (proof stress) of at least 370 MPa, a percent elongation of at least 2%, and a hardness between 170 and 260 BHN at room temperature. Further, in certain embodiments, alloys of the present invention may display high mechanical properties at temperatures up to about 800° C., up to about 850° C., up to about 900° C., up to about 950° C., or up to about 1000° C., wherein the temperature refers to the gas temperature to which the article is subjected. For instance, as shown in FIGS. 3-5, various embodiments of the alloy of the present invention provide comparable mechanical properties to those of other commercially-known heat-resistant steels.

In one embodiment, articles prepared using the alloy of the present invention are particularly capable of meeting or exceeding various standards for specific physical or mechanical properties. In some embodiments, mechanical properties are measured in accordance with ASTM E8 or another equivalent national standard on test bars. Preferably, a tensile sample is removed from the casting sample for testing. Where this is not possible, even with the smallest sample test dimension described in ASTM E8, the specimens for testing may be machined from keel blocks or Y-blocks that followed the same production process as the parts they are intended to represent. Ideally, the cooling conditions of the blocks after casting is similar to that of the castings and the wall thickness of the blocs should be representative of the thickest section of the casting. In some embodiments, wherein keel blocks or Y-blocks are used for testing, a minimum of three tensile tests are performed.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An alloy composition comprising:
about 0.6% to about 0.8% by weight carbon;
about 16% to about 18% by weight chromium;
about 4.5% to about 5.5% by weight nickel;
about 2.0% to about 5.0% by weight manganese;
about 0.8% to about 1.2% by weight tungsten;
about 0.8% to about 1.2% by weight molybdenum;
about 0.65% to about 0.85% by weight niobium;
about 0.3% to about 1.0% by weight silicon;
balance iron and unavoidable impurities, wherein percentages are based on the overall weight of the composition, and wherein the alloy comprises an austenitic structure having at least one of MC or $M_7C_3$ carbides.

2. The alloy composition of claim 1, further comprising one or more trace elements.

3. The alloy composition of claim 2, wherein the one or more trace elements comprise one or more of the following:
up to about 0.15% by weight nitrogen;
up to about 0.005% by weight boron;
up to about 0.03% by weight phosphorus; and
up to about 0.03% by weight sulfur.

4. The alloy of claim 1 further comprising the austenitic structure having $M_{23}C_6$ carbides formed during long-term thermal soaking.

5. A turbine housing or turbine manifold formed from an alloy comprising the alloy composition of claim 1.

6. The turbine housing or turbine manifold of claim 5, wherein the turbine housing or turbine manifold has an ultimate tensile strength of at least 465 MPa at room temperature when measured according to ASTM E8.

7. The turbine housing or turbine manifold of claim 5, wherein the turbine housing or turbine manifold has a yield strength (proof stress) of at least 370 MPa at room temperature when measured according to ASTM E8.

8. The turbine housing or turbine manifold of claim 5, wherein the turbine housing or turbine manifold exhibits a percent elongation of at least 2% at room temperature when measured according to ASTM E8.

9. The turbine housing or turbine manifold of claim 5, wherein the turbine housing or turbine manifold has a hardness at room temperature between 170 and 260 BHN, wherein the hardness is measured in conformance with EN ISO 6506-1:2005.

10. An alloy composition comprising:
about 0.6% to about 0.75% by weight carbon;
about 16% to about 18% by weight chromium;
about 4.5% to about 5.5% by weight nickel;
about 2.0% to about 4.5% by weight manganese;
about 0.8% to about 1.2% by weight tungsten;
about 0.8% to about 1.2% by weight molybdenum;
about 0.65% to about 0.85% by weight niobium;
about 0.3% to about 1.0% by weight silicon;
balance iron and unavoidable impurities, wherein percentages are based on the overall weight of the composition, and wherein the alloy comprises an austenitic structure having at least one of MC or $M_7C_3$ carbides.

11. The alloy composition of claim 10, further comprising one or more trace elements.

12. The alloy composition of claim 11, wherein the one or more trace elements comprise one or more of the following:
up to about 0.15% by weight nitrogen;
up to about 0.005% by weight boron;
up to about 0.03% by weight phosphorus; and
up to about 0.03% by weight sulfur.

13. The alloy of claim 10 further comprising the austenitic structure having $M_{23}C_6$ carbides formed during long-term thermal soaking.

14. A turbine housing or turbine manifold formed from an alloy comprising the alloy composition of claim 10.

15. The turbine housing or turbine manifold of claim 14, wherein the turbine housing or turbine manifold has an ultimate tensile strength of at least 465 MPa at room temperature when measured according to ASTM E8.

16. The turbine housing or turbine manifold of claim 14, wherein the turbine housing or turbine manifold has a yield strength (proof stress) of at least 370 MPa at room temperature when measured according to ASTM E8.

17. The turbine housing or turbine manifold of claim 14, wherein the turbine housing or turbine manifold exhibits a percent elongation of at least 2% at room temperature when measured according to ASTM E8.

18. The turbine housing or turbine manifold of claim 14, wherein the turbine housing or turbine manifold has a hardness at room temperature between 170 and 260 BHN, wherein the hardness is measured in conformance with EN ISO 6506-1:2005.

* * * * *